US006155959A

United States Patent [19]

Arroyo, Jr.

[11] Patent Number: 6,155,959

[45] Date of Patent: Dec. 5, 2000

[54] EXERCISE DEVICE

[76] Inventor: Joe Arroyo, Jr., 1970 S. Crystal, Fresno, Calif. 93706

[21] Appl. No.: 09/359,828

[22] Filed: Jul. 23, 1999

Related U.S. Application Data

[63] Continuation-in-part of application No. 09/030,638, Feb. 25, 1998.

[60] Provisional application No. 60/039,815, Feb. 26, 1997.

[51] Int. Cl.[7] ..... A63B 22/12

[52] U.S. Cl. ..... 482/62; 482/37; 482/51

[58] Field of Search ..... 482/51, 37, 57, 482/58, 59, 62, 63, 64

[56] References Cited

U.S. PATENT DOCUMENTS

| | | | |
|---|---|---|---|
| 5,199,932 | 4/1993 | Liao . | |
| 5,199,933 | 4/1993 | Illuzzi . | |
| 5,256,117 | 10/1993 | Potts et al. . | |
| 5,330,402 | 7/1994 | Johnson . | |
| 5,344,371 | 9/1994 | Wang . | |
| 5,378,214 | 1/1995 | Kreitenberg . | |
| 5,492,515 | 2/1996 | Charnitski . | |
| 5,620,400 | 4/1997 | Foster . | |
| 5,679,100 | 10/1997 | Charnitski . | |
| 5,749,810 | 5/1998 | Fenstermaker . | |
| 5,928,115 | 7/1999 | Arroyo, Jr. | 482/62 |

*Primary Examiner*—Danton D. DeMille
*Assistant Examiner*—Tam Nguyen
*Attorney, Agent, or Firm*—Mark D. Miller

[57] ABSTRACT

A vertically oriented exercise device for working out arms, legs or both arms and legs simultaneously is provided which includes a stationary base having a first adjustable vertical standard attached thereto. A rotatable pedal operated variable tension load wheel is provided near the bottom of the standard, and an adjustable seat is conveniently attached at a central location thereby allowing the user to comfortably sit while also reaching the pedals and hand grips. A second adjustable standard is provided which supports a pair of vertically oriented handles which are pivotally attached at the top of the second standard. The bottoms of these handles are attached through a set of linkages to the pedals on the load wheel. The linkages allow force applied by the user to the handles to directly turn the load wheel. Thus, the legs independently, the arms independently, or both the arms and legs together may be used to operate the load wheel. As a result, without exiting or changing anything on the exerciser, the user may shift the emphasis of force back and forth from the arms to the legs during a given workout. The user may also rest the legs while operating the device using only the arms, and vice versa. On the same base, a recumbent seat may also he provided which allows the user to exercise the legs only.

17 Claims, 6 Drawing Sheets

EXERCISE DEVICE

This Application claims the benefit of U.S. Provisional application Ser. No. 60/039,815, Filing Date: Feb. 26, 1997, and a C-I-P of Ser. No. 09/030,638 filed Feb. 25, 1998.

BACKGROUND OF THE INVENTION

1. Field of the Invention

The present invention relates to exercise equipment, and more particularly to a new and improved stationary device for simultaneous or independent exercising of the arms and legs of a human.

2. Description of the Prior Art

Numerous stationary exercise devices are known in the art, including stationary bicycles, treadmills, rowing machines, and stair stepping devices to name a few. However, with the exception of rowing machines and Nordic Track machines, few if any of these devices provide the opportunity of either simultaneous or independent workout for both arms and legs.

SUMMARY OF THE INVENTION

The present invention provides a vertically oriented exercise device for working out both arms and legs simultaneously or independently. A stationary base is provided having an adjustable vertical standard attached thereto. A rotatable pedal operated load wheel is provided near the bottom of the standard. Friction drag on the load wheel may be adjusted to make it easier or more difficult to rotate using the arms and/or the legs. A cushioned seat is provided for attachment to the standard at an adjustably convenient central location thereby allowing the user to comfortably sit thereon while also reaching the pedals attached to the load wheel. A pair of movable hand grips are provided near the upper end of the standard to be held by the user during exercise. Each of the hand grips is attached to a slidable vertical member, and each such member is attached through a set of pivoting linkages to the pedals on the load wheel. These linkages allow force applied to the hand grips to directly turn the load wheel. Thus, the legs independently, the arms independently, or both the arms and legs together may be used to turn the load wheel. As a result, without exiting or changing anything on the exerciser, the user may shift the emphasis of force back and forth from the arms to the legs during a given workout. The user may rest the legs while operating the device using only the arms, and vice versa.

In an alternative embodiment, the exercise device of the present invention may independently or additionally include a seat that is adjustably attached to the stationary base allowing the device to be used as a recumbent exercise machine for exercising the legs. The seat includes a pair of gripping handles which are attached thereto.

In another alternative embodiment, the exercise device of the present invention may independently or additionally include a second adjustable upright standard adjustably attached to the base. This standard supports a pair of vertically oriented handle members which are pivotally attached at the top of the standard. A hand grip is provided at the top of each handle member. The bottom of each handle member is hingedly attached to one end of a motion transmission member. The opposite end of each motion transmission member is attached at the pivot of one of the load wheel pedals. Thus, as the pedals move around the wheel, oscillating motion is imparted to each transmission member, and thus to each handle member. Alternatively, as the handle members are moved back and forth, the load wheel can be turned. This allows the user to shift the emphasis of force from the arms to the legs without exiting the exercise device.

It is therefore a primary object of the present invention to provide a stationary exercise machine which provides both simultaneous and independent workout of arms and legs.

It is a further important object of the present invention to provide a stationary exercise machine having a base and a vertical standard supporting a pedal operated load wheel, an adjustable seat, and a pair of slidable hand grips.

It is a further important object of the present invention to provide a stationary exercise machine having a vertical standard supporting a pedal operated load wheel, an adjustable seat, and a pair of slidable hand grips which are connected to the load wheel through a series of linkages thereby allowing the load wheel to be rotated by sliding the hand grips.

It is a further important object of the present invention to provide a stationary exercise machine having a pair of vertical standards, one standard supporting a load wheel and an adjustable seat, the other supporting a set of oscillating handle members connected to the load wheel through a series of linkages thereby allowing the load wheel to be rotated by oscillating the handle members.

It is another object of the present invention to provide a stationary exercise machine which allows the user to operate the load wheel using the legs independently, the arms independently, or both the arms and legs together.

It is a further object of the present invention to provide a stationary exercise machine which allows the user to shift the emphasis of force back and forth from the arms to the legs during a given workout without exiting the machine or changing anything on it.

It is a further object of the present invention to provide a stationary exercise machine which allows the user to rest the legs while operating the device using only the arms.

It is a further object of the present invention to provide a stationary exercise machine which allows the user to rest the arms while operating the device using only the legs.

It is a further object of the present invention to provide stationary base supporting a load wheel with pedals and an adjustable seat with handles attached thereto for use as a recumbent exercise machine for exercising the legs.

It is a further object of the present invention to provide a single stationary base for supporting a dual-use exercise machine having a pair of vertical standards, one standard supporting a load wheel and an adjustable seat, the other supporting a set of oscillating handle members connected to the load wheel through a series of linkages for exercising the arms and legs; and a second adjustable seat with handles attached thereto for use as a recumbent exercise machine for exercising only the legs.

It is a further object of the present invention to provide a single stationary base for supporting a tri-use exercise machine having a pair of vertical standards, one standard supporting a load wheel, an adjustable seat, and a pair of slidable vertical members with handles and linkages to the load wheel for exercising the arms and legs; a second standard supporting a set of oscillating handle members connected to the load wheel through a series of linkages for exercising the arms and legs; and a second adjustable seat with handles attached thereto for use as a recumbent exercise machine for exercising only the legs.

It is another object of the invention to provide an enjoyable exercise device.

Other objects of the invention will be apparent from the detailed descriptions and the claims herein.

DETAILED DESCRIPTION OF THE DRAWINGS

Figure 1:
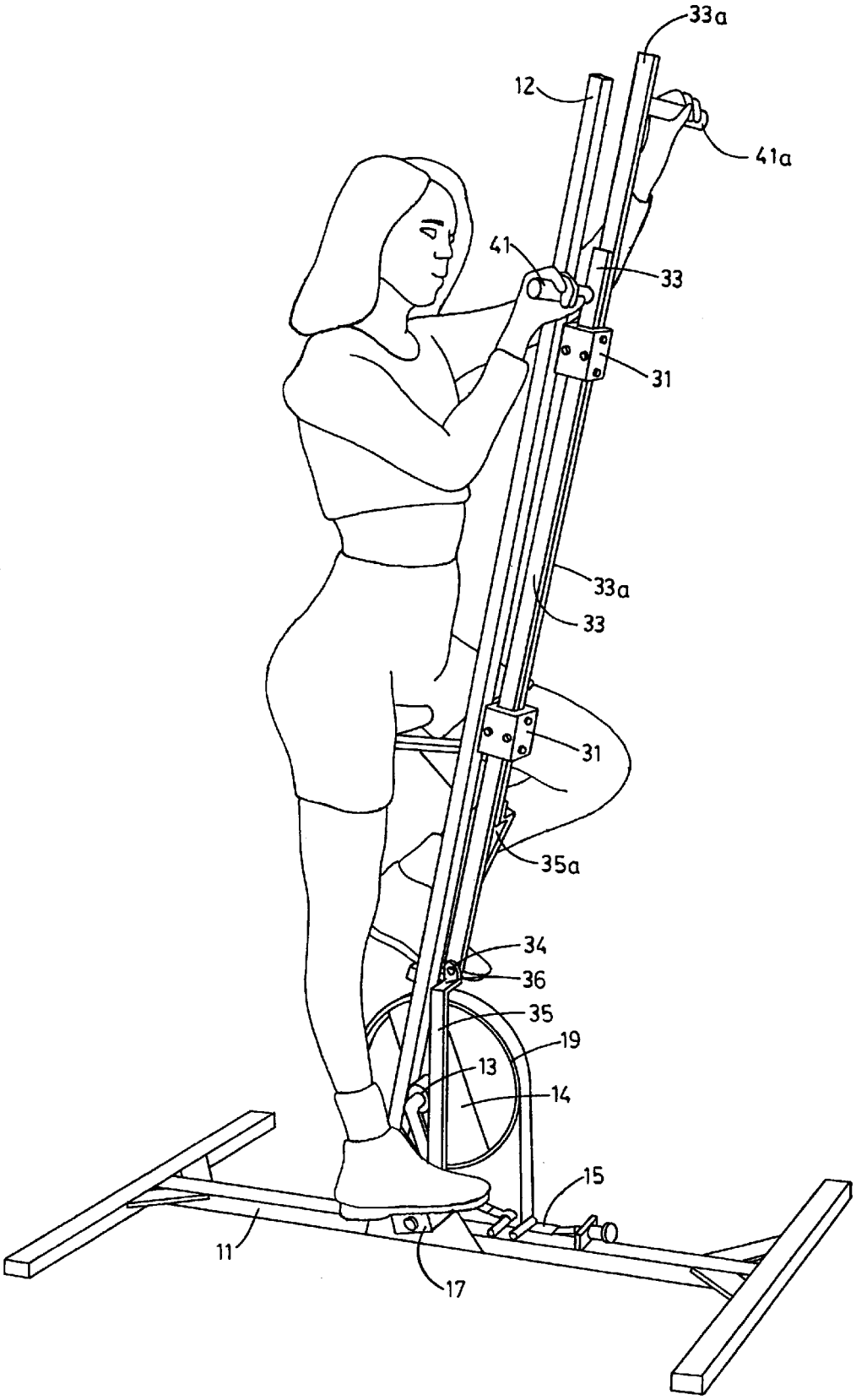
FIG. 1 is a perspective view of the present invention showing a user resting on the adjustable seat with feet on the pedals and hands holding the slidable grips.
Figure 2:
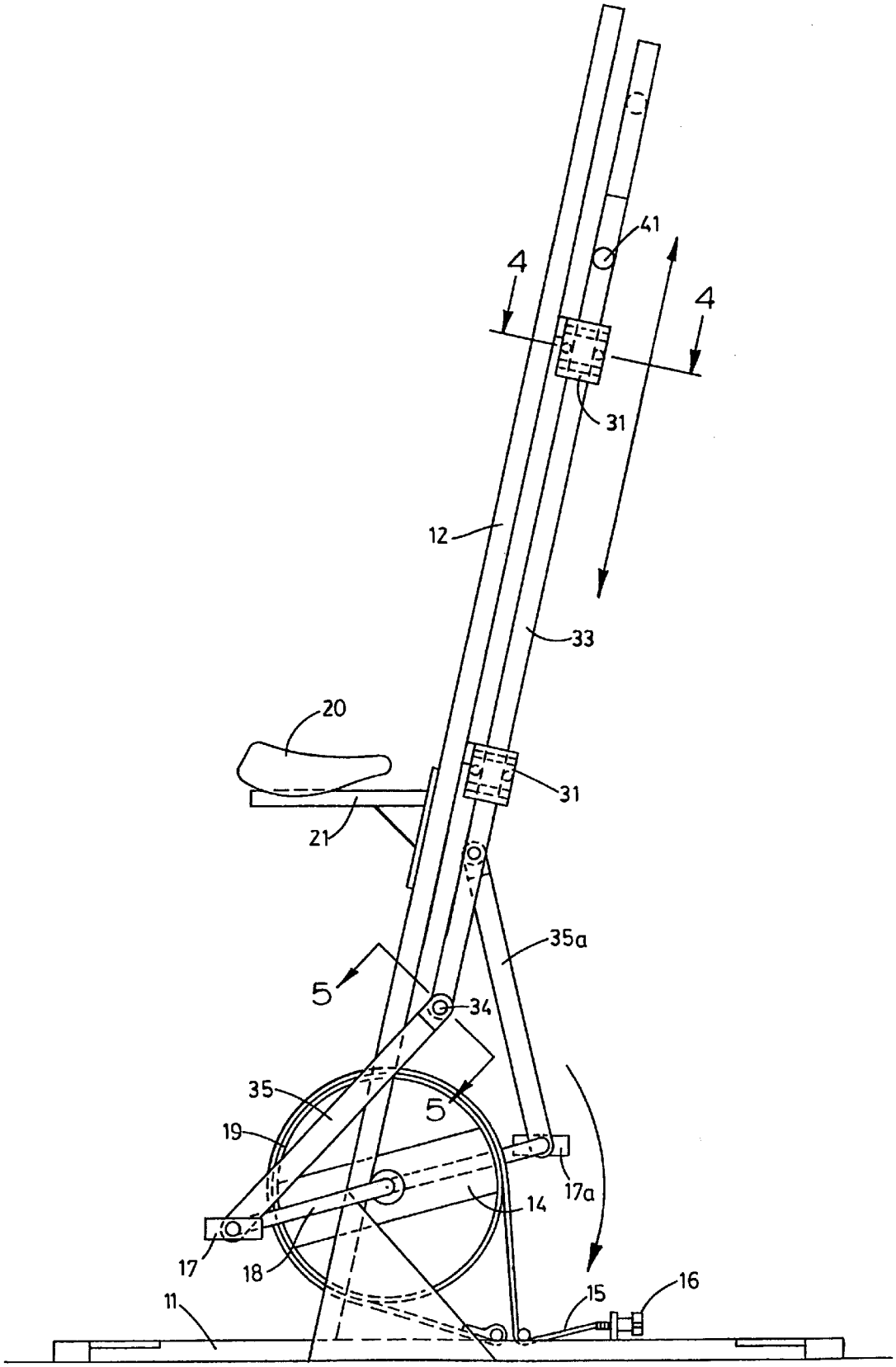
FIG. 2 is a side view of the present invention showing internal aspects using phantom lines.
Figure 3:
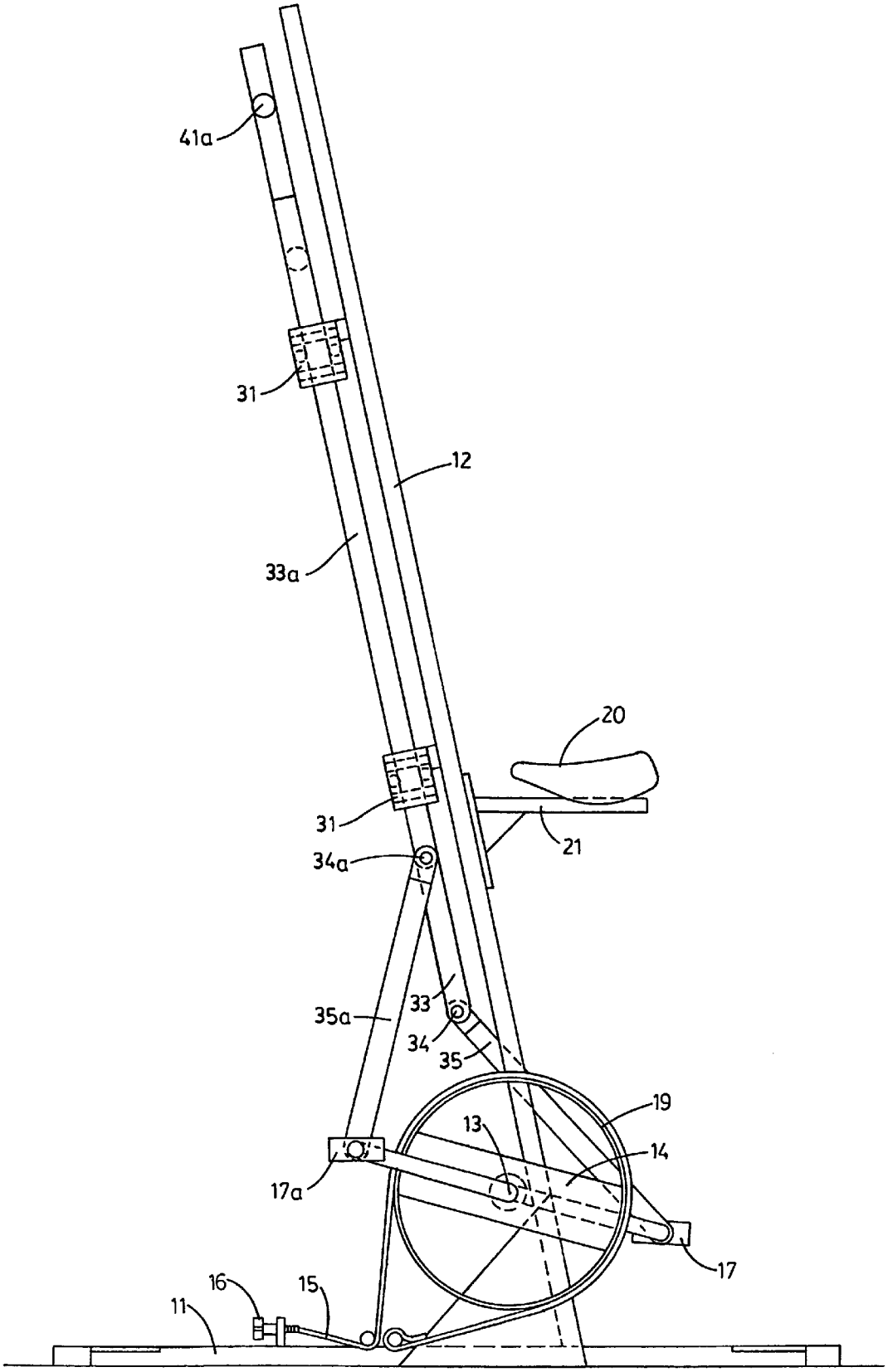
FIG. 3 is an opposite side view of the present invention showing internal aspects using phantom lines.

Referring to the drawings wherein like reference characters designate like or corresponding parts throughout the several views, and referring particularly to FIGS. 1–3 it is seen that the invention includes a support base 11 having a vertical standard 12 attached thereto. The load wheel 14 is rotatably attached to standard 12 near the bottom at pivot 13. An adjustable tension strap 15 is wrapped around wheel 14 and may be tightened or loosened to adjust friction drag on the load wheel using adjustment screw 16 on base 11. A pair of pedals 17 (and 17*a*) are pivotally attached to the center of wheel 14.

Strap 15 is attached around the outer edge of wheel 14 and is mounted at either end on base 11. One end of strap 15 is adjustable at 16 so as to allow different tension (friction) to be imparted to the wheel. The outer edge of wheel 14 is slidably (rotatably) attached to the wheel itself so that wheel 14 rotates inside edge 19.

A seat 20 is provided which may be adjustably attached to standard 12 at almost any location using support bar 21.

A pair of hand grips 41 (and 41*a*) are provided on the device. Grips 41 and 41*a* are attached, respectively, to the upper portions of slidable vertical members 33 and 33*a*. The positions of the hand grips may be adjusted to fit the user. At least two enclosures or housings 31 are provided along the length of standard 12 which guide, support and retain slidable members 33 and 33*a*. The lower ends of slidable members 33 and 33*a* are pivotally attached, respectively, to the upper ends of linking members 35 and 35*a* at pivots 34 and 34*a*. The lower ends of linking members 35 and 35*a* are pivotally attached, respectively, to the central pivots of pedals 17 and 17*a* (see FIGS. 2 and 3). This construction allows vertical force (whether up or down) applied to the hand grips to be transmitted through members 33 through linkages 34 and 35 to pedals 17 in order to rotate wheel 14.

Figure 4:
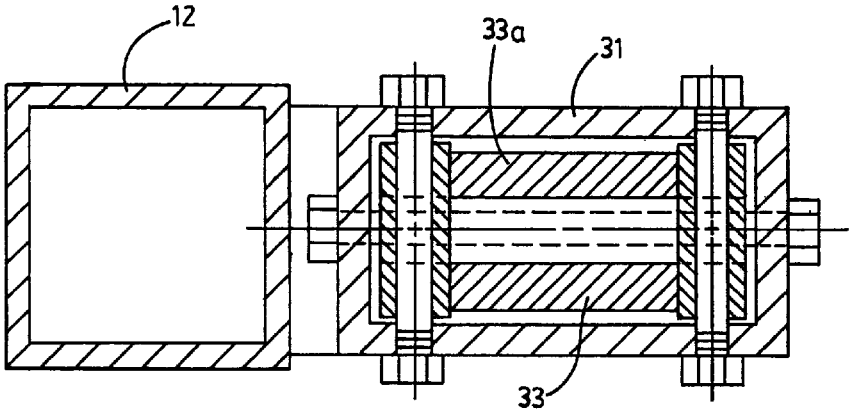
FIG. 4 is a cut away view along line 4—4 of FIG. 2.
Figure 5:
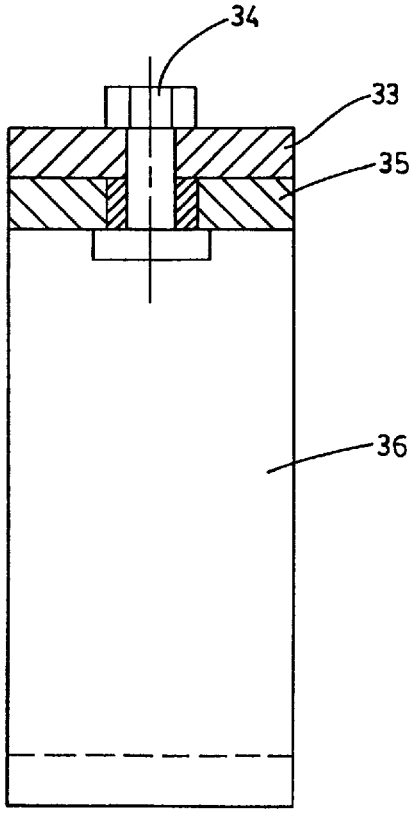
FIG. 5 is a cut away view along line 5—5 of FIG. 2.

Detail of a housing 31 is shown in FIG. 4. The housing 31 is made of two halves that are bolted together to allow firm support to members 33 while also making access possible for lubrication and repair. A flange 36 is provided at the top of each of members 35 to provide clearance between member 35 and wheel 14 as shown in FIGS. 1 and 5.

Figure 2A:
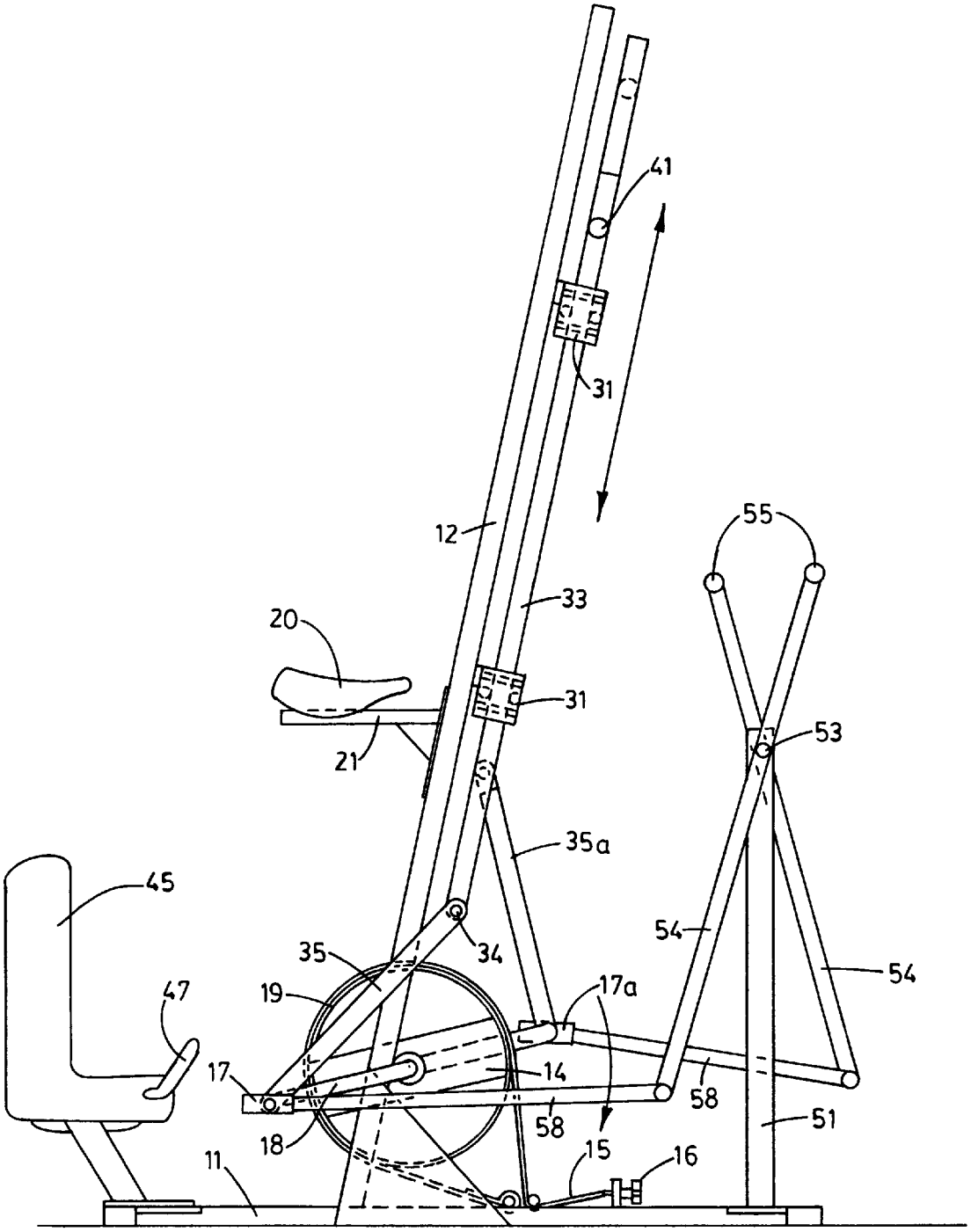
FIG. 2A is a side view of an alternative embodiment of the present invention showing a combination including the slidable vertical members, a recumbent seat, and a second vertical standard for supporting a second set of handles.
Figure 2B:
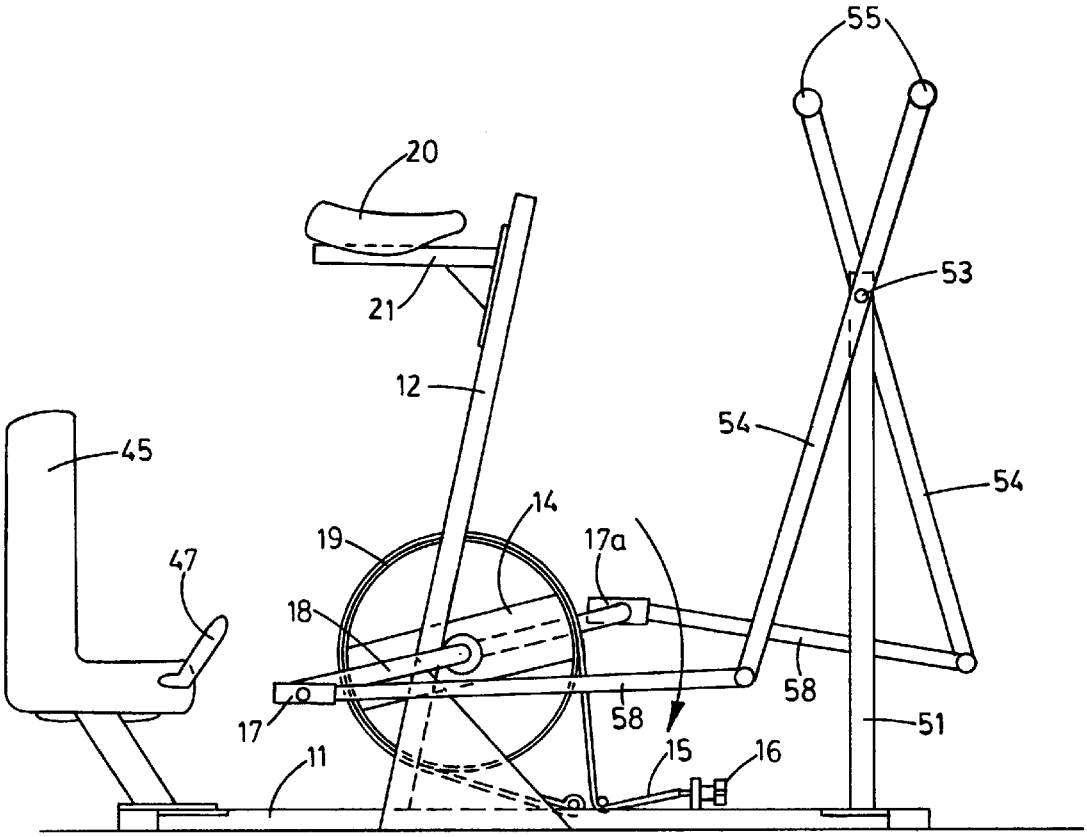
FIG. 2B is a side view of an alternative embodiment of the present invention showing the combination of a recumbent seat and a second vertical standard for supporting a second set of handles.

In the alternative embodiments shown in FIGS. 2A and 2B, it is seen that an adjustable seat 45 is provided on base 11. Seat 45 may be slidably adjusted by the user for optimum distance from pedals 17. Grip handles 47 are provided on seat 45 for the user to hold him/herself in position while pedaling the load wheel in a recumbent position. Seat 45, handles 47 and load wheel 14 with pedals 17 may be independently or additionally provided in the invention.

FIGS. 2A and 2B also illustrate another alternative or additional aspect of the invention utilizing a second adjustable vertical standard 51 which supports a pair of elongated oscillating handle members 54. Standard 51 may be adjusted both vertically and horizontally to place the handle members 54 in an optimum position for the user. Members 54 are pivotally attached to standard 51 at pivot 53. Hand grips or handles 55 are provided at the tops of members 54. A pair of transmission members 58 are provided between the lower ends of members 54 and pedals 17. This construction allows force applied to the pedals to move the handle members 54 back and forth, or force applied to the handle members 54 to rotate the load wheel 14.

The second vertical standard 51 supporting oscillating members 54 allows the user to exercise the arms. Thus, this embodiment may be provided in addition to, or as an alternative to the arm-exercising upper portion provided on the first standard 12. When provided as an alternative arm exerciser as shown in FIG. 2B, the upper portion of standard 12 above seat support bar 21 is eliminated, as are the slidable vertical members 33 and 33*a*, guides 31 and linking members 35 and 35*a*.

DESCRIPTION OF THE PREFERRED EMBODIMENTS

In the preferred embodiment all of the following parts should be made of sturdy metal or other suitable substance: base 11, vertical standard 12, pedal connectors 18, force imparting members 33 and 35, and guides 31. Wheel 14 may be constructed of heavy metal to retain inertia, to withstand the friction of the tension strap and to transmit heat away from the friction surface. Ball bearings, or other suitable structures may be used between wheel 14 and rim 19 thereof. Strap 15 should be made of metal fabric or other sturdy flexible material designed to withstand the friction and the heat. Vertical standard 12 should be at least six feet (6') in height, and seat 20 should be adjustable to fit along at least a three foot (3') section at the center thereof.

In the alternative embodiments of FIGS. 2A and 2B, seat 45 should be adjustable back and forth, as well as up and down, for different sized users so that each user may adjust the seat for optimum distance from the pedals of the load wheel. Vertical standard 51, handle members 54 and transmission members 58 should all be made of sturdy metal or other suitable substance.

It is understood that any suitable frictionally resistant load wheel 14 may be employed in the present invention.

It is preferred to include all of the embodiments together in a single exercise device to allow the user many different alternative exercises without the need for a large space and/or multiple machines, as shown in FIG. 2A. However, the embodiment of the recumbent seat and load wheel, as well as the embodiment of the second vertical standard and load wheel may be separated from the slidable vertical members of the device and used independently, as shown in FIG. 2B.

It is to be understood that variations and modifications of the present invention may be made without departing from the scope thereof. It is also to be understood that the present invention is not to be limited by the specific embodiments disclosed herein, but only in accordance with the appended claims when read in light of the foregoing specification.

I claim:

1. An exercise device providing for simultaneous or independent exercise of arms and legs of a human comprised of:

a. a stationary base made of a sturdy material;

b. a first vertically oriented standard made of sturdy material, the bottom of which is adjustably attached to said stationary base;

c. a rotatable load wheel mounted on said stationary base with a crank with crank arms operatively attached to the center of the load wheel and pedals mounted to the ends of the crank arm for actuation of rotation of said load wheel;

d. a drag strap mounted to said stationary base and around the outer rim of the load wheel made of sturdy flexible material;

e. a cushioned seat removably attached to said first vertical standard;

f. a second adjustable vertically oriented standard, adjustable attached to said base;

g. a pair of oscillating handles pivotally attached near the upper end of said second standard; and h. a pair of movable links connected to the bottom of said handles and to said rotatable pedals to transmit force from the handles to the load wheel.

2. An exercise device according to claim 1, wherein an adjustable recumbent seat having a pair of handles located thereon is also provided on said base.

3. An exercise device according to claim 2 wherein a pair of slidable vertical members are mounted to said first vertical standard, a pair of hand grips are attached near the upper end of said slidable vertical members, and a pair of movable links are provided between the bottoms of said slidable vertical members and said rotatable pedals to transmit force from the slidable vertical members to the load wheel.

4. An exercise device according to claim 1 wherein the cushioned seat is mounted to a sturdy metal bracket which attaches to said first vertical standard.

5. An exercise device according to claim 4 wherein the cushioned seat and mounting bracket is adjustable along the center section of the vertical standard.

6. An exercise device according to claim 4 wherein said cushioned seat and mounting bracket can be removed from the vertical standard.

7. An exercise device according to claim 1 wherein said load wheel is mounted near the bottom of the vertical standard.

8. An exercise device according to claim 7 wherein a pair of foot pedals are rotatably attached to the center of said load wheel.

9. An exercise device according to claim 7 wherein said load wheel is supported with ball bearings.

10. An exercise device according to claim 7 wherein movable links are pivotally attached to the bottom of said slidable vertical members and to said load wheel.

11. An exercise device according to claim 10 wherein the movable links are pivotally attached to the rotatable pedals to transmit reciprocating force from the slidable members to the load wheel.

12. An exercise device according to claim 7 wherein a heavy metal rim is attached to the outer edge of the load wheel to absorb friction wear and to transmit heat away from the outer surface of the metal rim.

13. An exercise device according to claim 1 wherein an adjustment device is mounted to said stationary base and attached to the end of the drag strap.

14. An exercise device according to claim 13 wherein tension on the drag strap can be adjusted with the adjustment device to change friction drag around the heavy metal rim of the load wheel.

15. An exercise device according to claim 1 wherein a pair of housings are mounted to the vertical standard to firmly support the vertical sliding members.

16. An exercise device according to claim 15 wherein the housings are made in halves, bolted together to accommodate lubrication and repair.

17. An exercise device according to claim 15 wherein the housings are flanged at the top to provide clearance between the vertical sliding members.

* * * * *